US012523239B2

(12) United States Patent
Blaha et al.

(10) Patent No.: US 12,523,239 B2
(45) Date of Patent: Jan. 13, 2026

(54) FAN

(71) Applicant: ebm-papst Mulfingen GmbH & Co. KG, Mulfingen (DE)

(72) Inventors: Niels Blaha, Bad Mergentheim (DE); Daniel Gebert, Oehringen (DE)

(73) Assignee: EBM-PAPST MULFINGEN GMBH & CO. KG, Mulfingen (DE)

( * ) Notice: Subject to any disclaimer, the term of this patent is extended or adjusted under 35 U.S.C. 154(b) by 0 days.

(21) Appl. No.: 18/517,902

(22) Filed: Nov. 22, 2023

(65) Prior Publication Data

US 2024/0175444 A1 May 30, 2024

(30) Foreign Application Priority Data

Nov. 25, 2022 (DE) ..... 102022131246.1

(51) Int. Cl.
*F04D 25/06* (2006.01)
*F04D 19/00* (2006.01)
(Continued)

(52) U.S. Cl.
CPC ..... *F04D 29/522* (2013.01); *F04D 19/002* (2013.01); *F04D 25/06* (2013.01); *F04D 25/08* (2013.01)

(58) Field of Classification Search
CPC ..... F04D 19/002; F04D 25/06; F04D 25/08; F04D 29/522; F04D 29/326
See application file for complete search history.

(56) References Cited

U.S. PATENT DOCUMENTS 5,645,483 A * 7/1997 Cushman ..... F24F 7/025 454/352
5,695,318 A * 12/1997 Harmsen ..... F04D 17/06 415/218.1
(Continued)

FOREIGN PATENT DOCUMENTS

CN 85100823 B * 9/1985
EP 1544472 A2 6/2005
(Continued)

OTHER PUBLICATIONS

Merriam-Webster.com page for channel, (URL:https://www.merriam-webster.com/dictionary/channel) (Year: 2024).*
(Continued)

*Primary Examiner* — Thomas Fink
(74) *Attorney, Agent, or Firm* — Dickinson Wright PLLC

(57) ABSTRACT

A fan with a housing which defines an axial flow channel having a cross-section, wherein the flow channel has a first axial portion on the suction side and a second axial portion adjoining in the flow direction. The flow channel has a first cross-section in the first axial portion a transitioning cross-section through the second axial portion. The cross-section is arranged concentrically in an imaginary rectangular base area, the side edges of which coincide at least in sections with a contour of the first cross-section, and wherein the flow channel has in its second axial portion an intermediate cross-section which widens in the flow direction within the base area and which, starting from the first cross-section, increases to a second cross-section at the pressure-side end of the second axial portion.

20 Claims, 3 Drawing Sheets

(51) Int. Cl.
*F04D 29/52* (2006.01)
*F04D 25/08* (2006.01)

(56) References Cited

U.S. PATENT DOCUMENTS

| | | | | |
|---|---|---|---|---|
| 6,814,542 | B2 * | 11/2004 | Marlander | F04D 29/30 416/243 |
| 8,672,614 | B1 * | 3/2014 | Fitzpatrick | F04D 29/4226 415/116 |
| 11,143,196 | B2 * | 10/2021 | Kennedy | F04D 17/06 |
| 2007/0280840 | A1 * | 12/2007 | Sugiyama | F04D 25/0613 417/423.5 |
| 2008/0031722 | A1 * | 2/2008 | Yoshida | F04D 19/007 415/68 |
| 2009/0226299 | A1 | 9/2009 | Jin | |
| 2013/0209294 | A1 * | 8/2013 | Iwamoto | F04D 25/0613 417/423.14 |
| 2018/0258947 | A1 | 9/2018 | Hirose et al. | |
| 2023/0033024 | A1 * | 2/2023 | Chiu | F04D 17/06 |

FOREIGN PATENT DOCUMENTS

| | | | |
|---|---|---|---|
| EP | 2418388 | A2 | 2/2012 |
| JP | 2022-96823 | A | 6/2022 |
| WO | 2015185314 | A1 | 12/2015 |

OTHER PUBLICATIONS

German Search Report dated Sep. 13, 2023.

* cited by examiner

FAN

RELATED APPLICATIONS

This application claims priority to German Patent Application No. 10 2022 131 246.1, filed Nov. 25, 2022, the entire contents of which is incorporated herein by reference in its entirety.

FIELD

The disclosure relates to a fan having a compact design within which an increase in efficiency is made possible by converting a dynamic pressure into a static pressure.

BACKGROUND

Fans usually have an impeller with blades rotating about an axis of rotation and by means of which a flow directed through a flow channel can be generated. With its rotating blades, the impeller generates a mixture of static pressure and dynamic pressure, the sum of which is referred to as the total pressure. The dynamic pressure contains both an axial and a rotating component, which can also be referred to as a swirl. Since the dynamic pressure is undesirable, particularly due to its rotating component, a high proportion of dynamic pressure leads to a reduction in the efficiency of the fan.

A multiplicity of fans are already known from the prior art, wherein attempts are made to reduce the dynamic pressure by various measures. For example, EP 1 544 472 B1 proposes blades that are twisted in the flow direction. Furthermore, EP 2 418 388 B1 proposes a special design and arrangement of the blade ends.

BRIEF SUMMARY

The disclosure overcomes the aforementioned disadvantages and provides a preferably compact fan with which the efficiency can be further increased, in particular by reducing the dynamic pressure.

Thus, according to the disclosure, a fan having a fan housing is proposed, which fan housing defines an axial flow channel leading from a suction side to a pressure side. In the flow channel, a flow directed from the suction side to the pressure side can be generated in particular by an impeller arranged therein, which can be driven by a motor. The flow channel has a first axial portion on the suction side and a second axial portion adjoining. and in particular directly adjoining, in the flow direction, with the second axial portion preferably serving to convert a dynamic pressure of the flow into a static pressure. For this purpose, it is provided that the flow channel in the first axial portion has a first cross-section, at least at a transition to the second axial portion, which, or the contour of which, is preferably round or at least substantially round and, for example, is formed to be rotationally symmetrical. The first cross-section or contour thereof is arranged concentrically in an imaginary rectangular and in particular square base area which, accordingly, is not physically present. The side edges of the rectangular base area preferably each coincide with the contour of the first cross-section, at least in sections, and in particular at certain points. In its second axial portion, the flow channel has a cross-section that widens in the flow direction within the imaginary base area, so that none of the cross-sections of the flow channel in the second axial portion protrude beyond the imaginary rectangular base area. The cross-section of the flow channel thus increases in the second axial portion, starting from the first cross-section, in particular continuously, further in particular constantly, and further in particular linearly, to form a second cross-section at the pressure-side end of the second axial portion. Since the cross-section is forced to utilize the space provided by the base area, it is to be noted that the cross-section in the second axial portion or the contour thereof increasingly approaches the imaginary rectangular base area in the flow direction.

Additionally, it should be pointed out that in the present case, cross-section can also be understood to mean a cross-sectional contour of an internal lateral surface of a wall of the fan housing that delimits the flow channel radially on the outside.

Although it is known in some cases in the prior art to reduce the dynamic pressure by widening an outlet-side section of the flow channel, no consideration is given to the installation space requirement, so that the installation space greatly increased in most cases due to the widening orthogonal to the axis of rotation.

In summary, in the present disclosure the rotating velocity component of the dynamic pressure or the dynamic pressure itself should be reduced by widening the flow channel, which becomes increasingly rectangular or square, wherein the widening should take place within the installation space defined by the impeller or the first cross-section, so that the space or installation space requirement orthogonal to the axis of rotation does not increase.

The flow is decelerated and its inherent swirl (rotating component) is reduced both by the contour of the cross-section becoming increasingly rectangular or square from the suction side to the pressure side or by the contour approaching the rectangular base area and by the increasing cross-sectional area. Specifically, the increasing cross-sectional area reduces the axial component of the dynamic pressure and the contour becoming increasingly rectangular or square reduces the swirl.

The dynamic pressure can further be reduced in that the transition area formed by the second axial portion between the first cross-section and the second cross-section is selected to be as long as possible within the available installation space, so that the second axial portion defines a correspondingly large part of the overall length of the fan housing.

For further reduction and as explained in more detail later, a third axial portion with a constant cross-section can also be connected downstream of the second axial portion, in which a guide wheel can be arranged so that the third axial portion forms a guide stage.

A particularly advantageous further development provides for the cross-section of the flow channel to widen continuously and/or constantly and in particular linearly over the entire second axial portion, i.e. over the entire axial length thereof.

As already mentioned, the length of the transition area formed by the second axial portion between the first and the second cross-section has a strong influence on the swirl reduction or the reduction of the dynamic pressure. Therefore, one variant provides for the fan housing to have an overall length in the axial direction, wherein the second portion has a length in the axial direction of at least one third, in particular at least half, further in particular at least two thirds, of the overall length.

Alternatively, the length of the second axial portion can also be defined in relation to the length of the first axial portion. In this case, it is accordingly provided that the second axial portion comprises a multiple of the length of the first axial portion and, for example, double or at least double the length of the first axial portion.

In order to clarify that the fan or the fan housing preferably has an elongated design along the axial direction, i.e. along the flow direction or the axis of rotation, the fan housing can also further be designed in such a manner that the overall length of the fan housing is in particular greater than a width of the fan housing that is orthogonal thereto.

In particular, the first cross-section is at least substantially round and has a diameter that corresponds at least substantially to an edge length of the rectangular base area, so that the contour of the first cross-section has four points of contact with the side edges of the base area that are offset or rotated by 90° relative to each other.

With regard to the cross-section becoming larger in the second axial portion, it is preferably provided that the contact points of the cross-section in the second axial portion widen from the first cross-section towards the second cross-section to form contact lines that become longer, which preferably applies to each of the contact points. In this case, the contact lines become longer the further away the respective cross-section is from the first cross-section or the closer the respective cross-section is to the second cross-section.

Accordingly, the result is that the cross-section preferably corresponds in each case to an intersection between the base area and a circular area that increases along the flow direction, wherein the base area and the circular area or circular areas are arranged concentric to one another.

Of course, the fan can have an impeller arranged in the flow channel to generate the flow. In this case, it is preferably provided that the impeller is arranged at least in sections in the first axial portion and the second axial portion and, in particular, extends over the entire axial length of the second axial portion.

In this case, the impeller can have a cover disk which, viewed in the flow direction, begins in the region of the first axial portion and ends at the transition of the first axial portion to the second axial portion. Accordingly, the transition of the first axial portion into the second axial portion can also be defined in relation to the cover disk in that the transition is arranged at a pressure-side end of the cover disk.

According to a further advantageous variant and as already described, it can be provided that the flow channel has a third axial portion, in particular directly adjoining the second axial portion in the flow direction. The flow channel preferably has a constant cross-section along or over the entire third axial portion and, in particular, the constant second cross-section.

In the flow direction, the third axial portion can then be adjoined, in particular directly, by a blow-out opening of the flow channel.

For better producibility or production, for example through improved demoldability, the fan housing can be designed in two parts, wherein the first axial portion and the second axial portion are provided in a first partial housing and the third axial portion in a second partial housing.

If a third axial portion is provided and in particular in conjunction with the two-part design of the housing, the fan can furthermore have a guide wheel arranged in the third axial portion, which is preferably arranged exclusively in the third axial portion. It is understood that a guide wheel is stationary and cannot be rotated about the axis of rotation.

For further swirl reduction, the guide wheel can have a hub which is arranged concentric to the base area and/or the flow channel and which is formed by a cone tapering in the flow direction, so that the hub is reduced in a conical manner in the flow direction. This leads to a further increase in the flow area through which the flow passes, which is delimited radially on the outside by the cross-section of the flow channel and radially on the inside by the hub or the cross-section of the hub. Due to the combination of the tapered hub with at least the features of the main claim, a very efficient pressure recovery can take place since the increase in surface area in or along the second axial portion initially takes place radially outside, i.e. in the outer region of the flow, which is supported by the swirling flow. The increase in area in the hub region, i.e. in the third axial portion, only takes place when a large part of the swirl has already been converted by the cross-section of the flow channel becoming increasingly rectangular or square and the guide wheel.

Preferably, the guide wheel is formed integrally with the fan housing or the second partial housing and has guide vanes extending from a wall of the fan housing which defines the flow channel, which accordingly also defines the cross-section of the flow channel, to the hub.

The guide wheel can form a motor holder for holding a motor driving the impeller inside the fan housing.

Such a motor is, for example, an external rotor motor whose stator is held in the flow channel by the motor holder formed by the guide wheel and whose rotor is formed integrally or at least in one piece with the impeller.

On the suction side and preferably directly on the suction side of the first axial portion, a suction opening can also be provided from which in particular an inflow or suction nozzle extends into the flow channel. Accordingly, the inflow or suction nozzle can be provided within the first axial portion.

At the end face, the inlet nozzle can adjoin the first axial portion.

Irrespective of the effect of the swirl reduction, the compact design can be obtained or improved by utilizing the additional available installation space without increasing the installation space requirement. For this purpose, it can be provided, for example, that the fan housing forms heat sinks or, in particular, cooling fins and/or struts to improve stability in an area determined by a difference in the cross-section of the flow channel from the base area. In other words, the region delimited by the base area, where the flow channel does not completely require them, can be used for further components and in particular heat sinks or struts.

Although the base area is preferably invariable or constant over the entire axial extent or in the axial direction or flow direction, i.e. along the axis of rotation of the impeller, a slight deviation, which results in particular from manufacturing tolerances and/or desirable draft angles, can be tolerated or provided. Therefore, for the formation of draft angles, the flow channel and/or the base area can increase continuously in the flow direction, at least in the first or second axial portion and preferably in the first and second axial portions. However, extremely small values are to be assumed, so that the base area increases over the total length of the second section, for example, by a maximum of 5% and in particular by a maximum of 1%.

The features disclosed above can be combined as desired, provided this is technically possible and they do not contradict each other.

BRIEF DESCRIPTION OF THE DRAWINGS

Other advantageous embodiments of the disclosure are illustrated in more detail below together with the description of the preferred embodiment of the disclosure with reference to the figures. In the figures.

DETAILED DESCRIPTION

The figures are schematic examples and preferably show different views of a fan. Identical reference signs in the figures therefore indicate identical functional and/or structural features.

The fan 1 achieves a high efficiency or a high degree of effectiveness within a limited installation space, in particular orthogonal to the axis of rotation R, which is achieved in that the flow channel 20, which extends from the suction side A through the fan housing 10 to the pressure side B, is divided into multiple axial portions 21, 22, 23, which differ in terms of their cross-sections and function.

Figure 1:
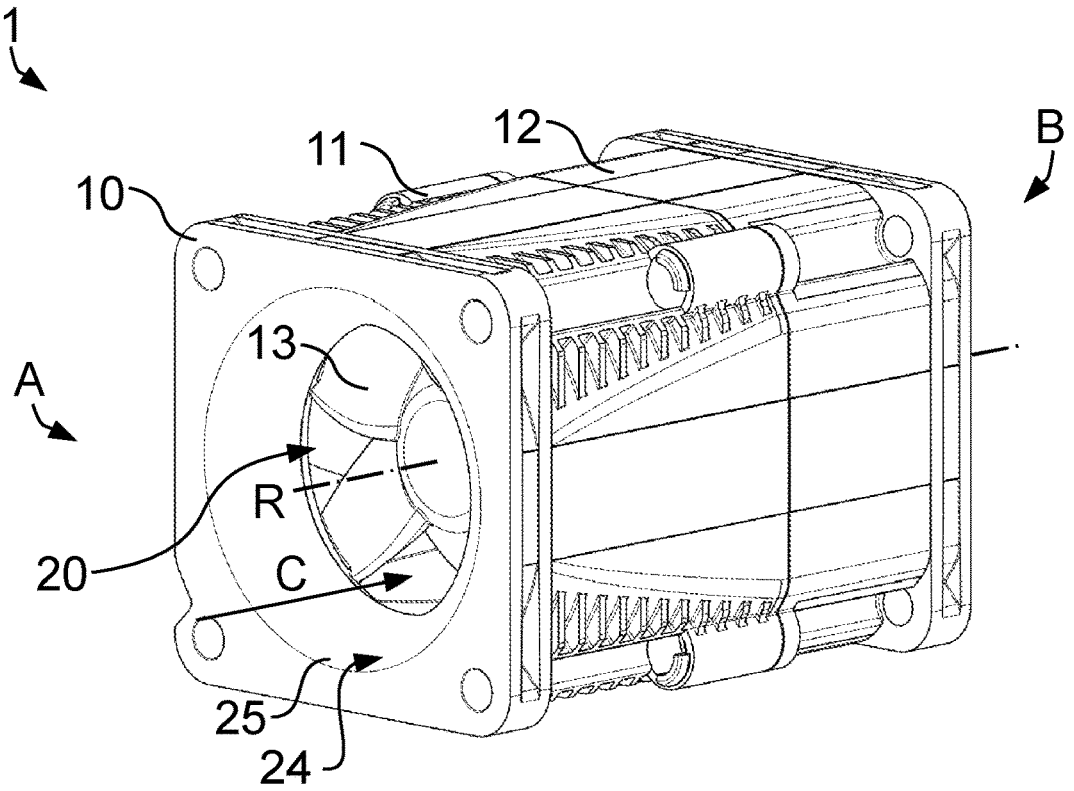
FIG. 1 shows an overall perspective view of a fan.
Figure 4A:
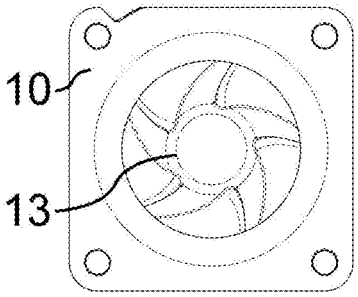
FIG. 4*a* shows a suction-side view of the fan.

For the sake of clarity, FIG. 1 shows the fan 1 with its two-part fan housing 10, with the flow channel 20 extending from the suction side A in the flow direction C through the first partial housing 11 and the second partial housing 12 adjoining in the flow direction C. The flow directed in flow direction C is generated by the impeller 13 arranged in the flow channel 20 and driven about the axis of rotation R by a motor 18. The impeller 13 is also visible in particular in the suction-side illustration of the fan 1 according to FIG. 4*a*.

A fluid, for example air, is sucked in by the impeller 13 on the suction side A through the suction opening 24 formed with or as an inflow or suction nozzle 25 and blown out on the pressure side B.

Figure 2:
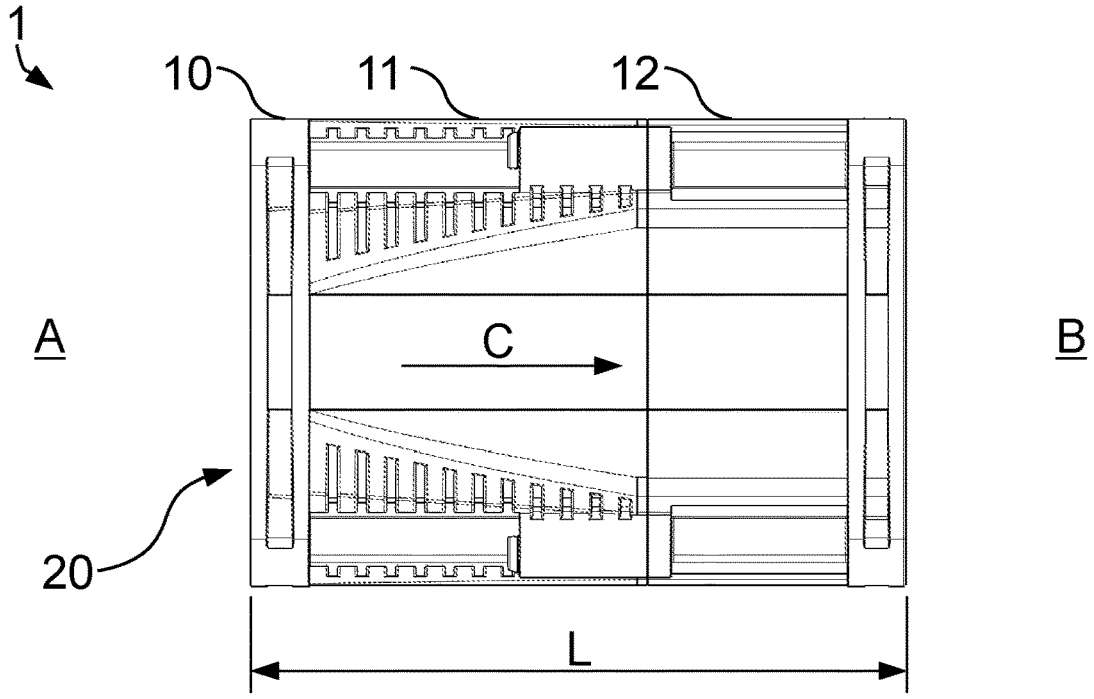
FIG. 2 shows side view of the fan.

It can be seen from FIG. 1 and in particular in conjunction with FIG. 2 that the fan 1 has an elongated or cuboidal basic shape, wherein the overall length L of the fan 1 or the fan housing 10 in the axial direction, i.e. along the axis of rotation R, is greater than a width of the fan 1 transverse or orthogonal to the axis of rotation R.

Figure 3:
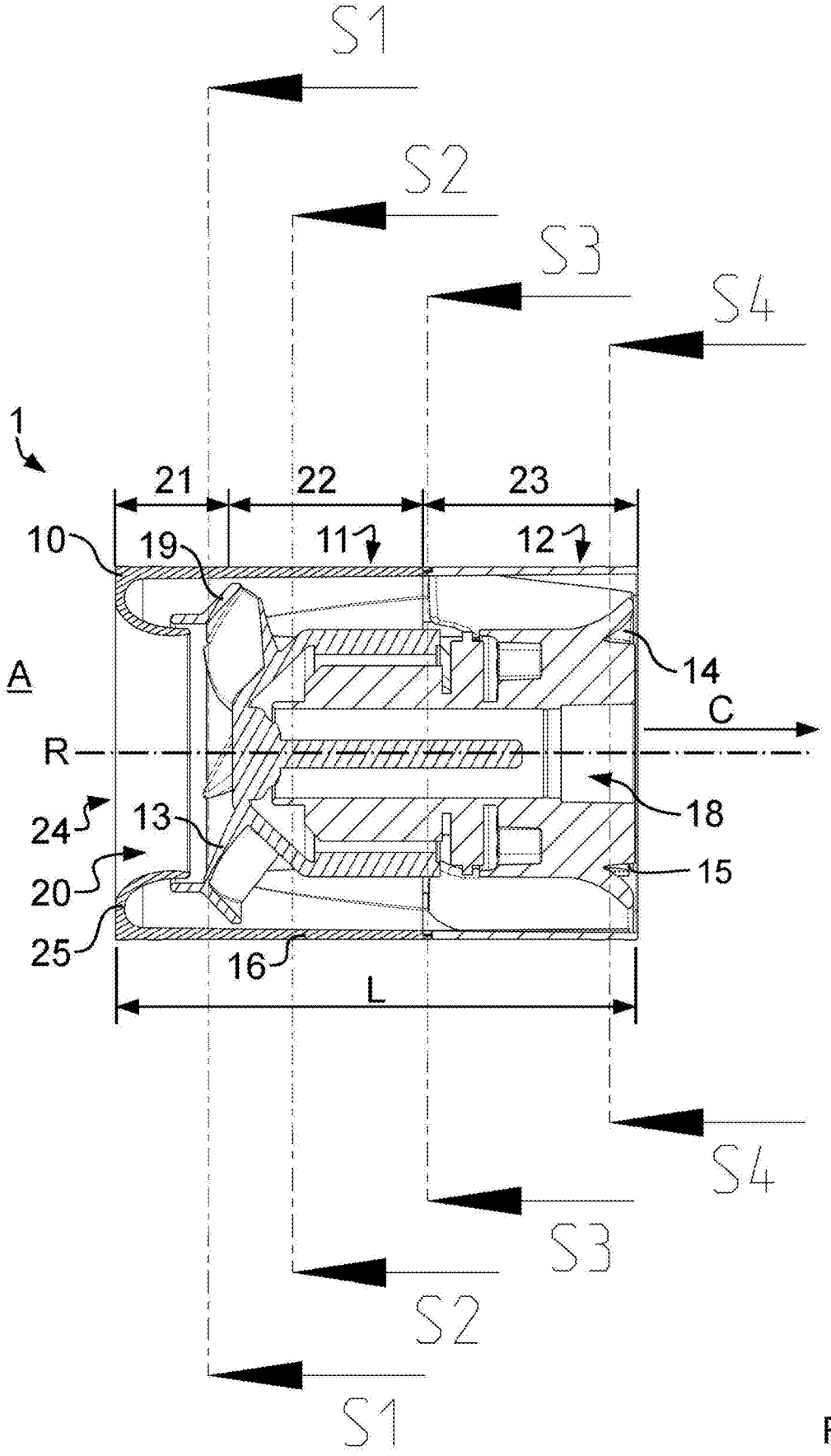
FIG. 3 shows a longitudinal section through the fan.

The illustration according to FIG. 3 corresponds to a longitudinal section along the axis of rotation R through the fan 1, wherein the axial portions 21, 22, 23 of the flow channel 20 following one another in the axial direction, i.e. along the axis of rotation R, are shown.

On the suction side, the suction nozzle 25 extends in the first axial portion 21 to the impeller 13 and into a space defined by a cover disk 19 of the impeller 13. The impeller 13 is arranged in sections both in the first axial portion 21 and in the second axial portion 22. The cover disk 19 of the impeller 13 extends, starting in the first axial portion 21, in the direction of the second axial portion 22 and ends in the axial direction at the transition from the first axial portion 21 to the second axial portion 22. A guide wheel 14 is arranged in the third axial portion 23 immediately following the second axial portion 22 in the flow direction C and is formed integrally, i.e. in one piece, with the fan housing 10 or, more precisely, the second partial housing 12.

Figure 4B:
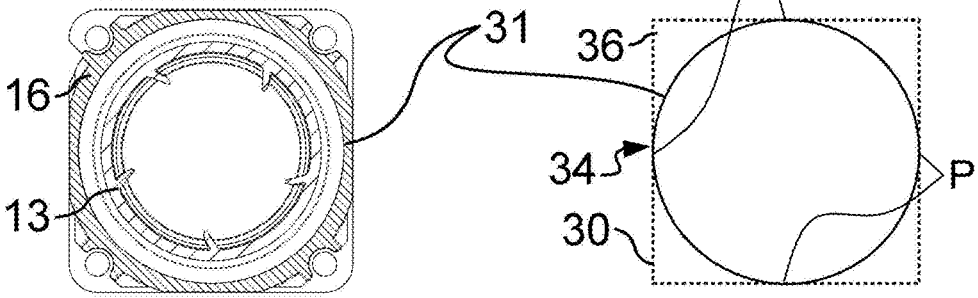
FIG. 4*b* shows a cross-section through the fan according to section line S1-S1.
Figure 4C:
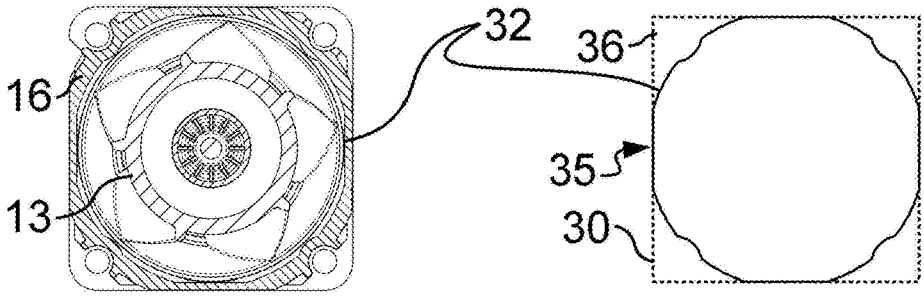
FIG. 4*c* shows a cross-section through the fan according to section line S2-S2.
Figure 4D:
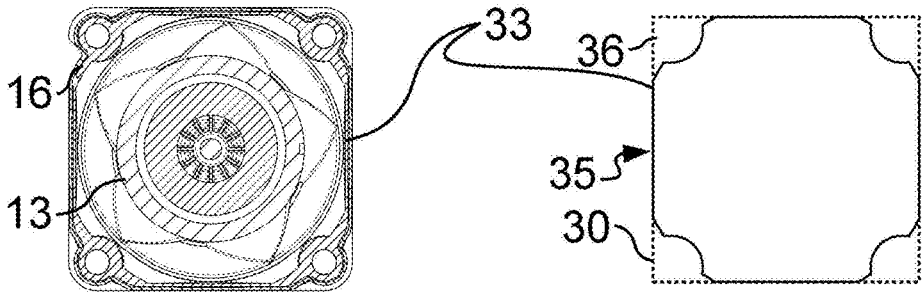
FIG. 4*d* shows a cross-section through the fan according to the section line S3-S3.
Figure 4E:
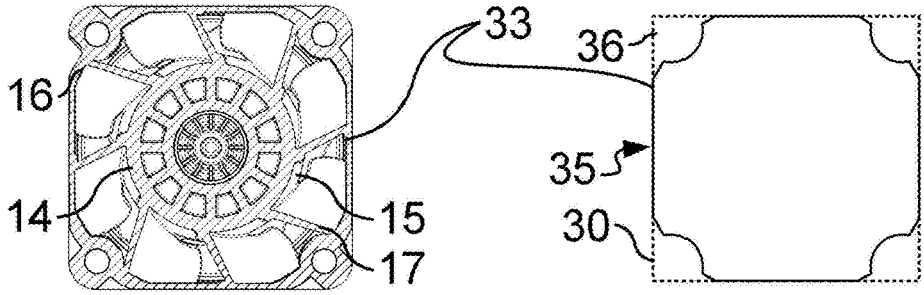
FIG. 4*e* shows a cross-section through the fan according to the section line S4-S4.
Figure 4F:
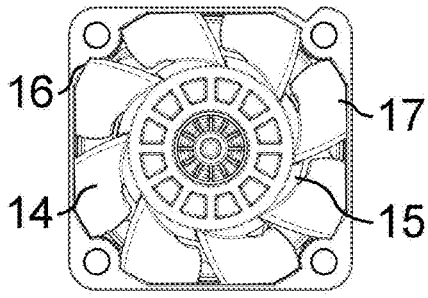
FIG. 4*f* shows a pressure-side view of the fan.

The longitudinal section according to FIG. 3 also shows the conically shaped hub 15 of the guide wheel 14, which leads to an increase in the cross-section through which flow can pass in a radially inner region of the flow channel 20, as is also clearly visible in the pressure-side view according to FIG. 4*f*.

It is substantial that the cross-section through the flow channel 20 is not constant over the entire length L of the fan housing 10, but that the cross-section and thus the cross-sectional area through which the fluid can flow increases, so that a dynamic pressure is reduced or converted as a result.

For this purpose, the flow channel 20 has a first cross-section 31 at least at the transition from the first axial portion 21 to the second axial portion 22 in accordance with the section line S1-S1 drawn in FIG. 3, as shown in FIG. 4*b*. The flow channel 20 can have the substantially same or constant first cross-section 31 over the entire first axial portion 21, which corresponds to the impeller 13, so that the impeller can rotate freely within this cross-section 31.

It applies for each of the FIGS. 4*b* to 4*e* that the cross-section through the fan 1 is shown on the left-hand side of the plane of illustration in accordance with the respective sectional views shown in FIG. 3 and a simplified illustration of the contour of the respective cross-section is shown on the right-hand side of the plane of illustration.

It is additionally to be noted that in the present patent application, the term cross-section is understood in particular to mean the inner contour of the wall 16 radially delimiting the flow channel 20 on the outside, which therefore corresponds to the contour or outer contour of the flow channel 20. The flow channel 20 is delimited radially on the inside by further components, such as the impeller 13, a rotor bell of the motor 18 or the hub 15 of the guide wheel 14.

Between this radially outer limitation of the flow channel 20 formed by the wall 16 and the radially inner limitation of the flow channel 20 formed by the further components of the fan 1, the actual cross-section through which a flow can pass or the cross-sectional area of the flow channel 20 through which a flow can pass is determined, wherein it can be assumed in the present case that the cross-sectional area through which a flow can pass increases as a function of or together with the cross-section of the flow channel 20.

The swirl reduction within the fan housing 10 is achieved in particular in and through the second axial portion 22 of the flow channel 20, wherein the swirl reduction can be further increased by the subsequent third axial portion 23.

In the second axial portion 22, mainly two effects lead to the swirl reduction. Firstly, the second axial portion 22 is formed to be comparatively long such that it has a length of more than a third of the total length L of the fan housing 10 in the axial direction. Furthermore, for example, the second axial portion 22 shown in FIG. 3 has a total axial length that is twice as long as the first axial portion 21. Furthermore, the cross-section in the second axial portion 22 is continuously increased from the first cross-section 31 shown in FIG. 4*b* to the second cross-section 33 shown in FIG. 4*d*. In this context, FIG. 4*c* shows an intermediate cross-section between these cross-sections 31, 33 or a cross-section 32 at a specific position, wherein the actual cross-section differs due to the continuous change of the intermediate cross-section depending on the position in the axial direction along the second axial portion 22.

In order to substantially fully utilize, but not increase, the available installation space, the first cross-section 31 defines a rectangular and, in the present case, square base area 30. The entire increase of the cross-section therefore takes place within the base area 30 without going beyond it, wherein the base area 30 can widen in the flow direction C to thereby provide draft angles.

Therefore, the flow channel 20 in its second axial portion 22 has a cross-section that widens, i.e. increases, in the flow direction C within the base area 30, wherein the intermediate cross-section 32 is shown as an example according to FIG. 4*c*. The intermediate cross-section therefore increases starting from the first cross-section 31 according to FIG. 4*b* to the second cross-section 33 according to FIG. 4*e* at the pressure-side end of the second axial portion 22, wherein the second cross-section 33 remains unchanged, i.e. constant, over the entire third axial portion 23.

The swirl or dynamic pressure is further reduced by the guide wheel 14 arranged in the third axial portion 23.

By increasing the cross-section in the second axial portion 22 and the accompanying increase in the cross-sectional area through which the flow can pass, a very efficient pressure conversion, i.e. a conversion of the dynamic pressure into a static pressure, initially takes place in the radially outer region of the flow channel 20. In addition, the swirl is reduced in particular by the shape of the cross-sectional area approaching the rectangular base area or the shape of the cross-sectional area becoming increasingly rectangular in the flow direction.

A large part of the remaining swirl is then converted by the downstream guide wheel 14.

The swirl reduction is supported in the third axial portion 23 by the conical hub 15, which leads to a further increase in the cross-sectional area through which a flow can pass in the radially inner region of the flow channel 20.

It is further advantageous that the guide wheel 14 or the hub 15 of the guide wheel 14 can also serve as a motor holder for the motor 18 since the guide vanes 17 extend radially inwards from the wall 16 of the fan housing 10 or the second partial housing 12 anyway.

For improved demoldability, it can also be provided that the imaginary base area 30 is slightly larger in the flow direction C in order to form a draft angle in this manner. As a result, the wall 16 becomes increasingly thinner, at least in the first and second axial portions 21, 22, from the suction side A in the flow direction C to the pressure side B and as shown in particular in FIG. 3.

The disclosure is not limited in its embodiment to the preferred exemplary embodiments given above. Rather, many variants are conceivable which also make use of the illustrated solution even in fundamentally different embodiments.

The invention claimed is:

1. A fan having a fan housing which defines an axial flow channel having a varying cross-section and leading from a suction side (A) to a pressure side (B) and in which a flow directed from the suction side (A) to the pressure side (B) can be generated in a flow direction (C), wherein the flow channel has a first axial portion on the suction side and a second axial portion adjoining the first axial portion in the flow direction (C), wherein the flow channel has a first cross-section in the first axial portion at least at a transition from the first axial portion to the second axial portion, wherein the varying cross-section is arranged concentrically in an axial projection of an imaginary rectangular base area, and the side edges of the axial projection of the imaginary rectangular base coincide at least in portions with an outer periphery of the first cross-section, and wherein the flow channel in its second axial portion has a plurality of intermediate cross-sections which widen in the flow direction (C) within the axial projection of the imaginary rectangular base area and which, starting from the first cross-section, increases to a second cross-section at the pressure-side end of the second axial portion, so that an outer periphery of the varying cross-section widens in the flow direction (C) and increasingly approaches the projection of the imaginary rectangular base area from the first cross-section to the second cross-section such that an outer periphery of the varying cross-section increasingly takes a rectangular shape of the axial projection of the imaginary rectangular base area.

2. The fan according to claim 1, wherein the plurality of intermediate cross-sections of the flow channel widens continuously and/or constantly over the entire second axial portion.

3. The fan according to claim 1, wherein the fan housing has an overall length (L) in the axial direction which is greater than a width of the fan housing which is orthogonal thereto, and the second axial portion has a length in the axial direction of at least one third of the total length (L).

4. The fan according to claim 1, wherein the first cross-section has a round outer periphery and has a diameter which corresponds to an edge length of the rectangular base area, so that the outer periphery of the first cross-section has four contact points (P), which are offset by 90° relative to each other, with the side edges of the imaginary rectangular base area.

5. The fan according to claim 4, wherein the contact points of the first cross-section transition from contact points to contact lines from the first cross-section towards the second cross-section, the contact lines becoming increasingly longer towards the second cross-section.

6. The fan according to claim 1, further having an impeller arranged in the flow channel for generating the flow, wherein the impeller is arranged at least in sections in the first axial portion and the second axial portion and extends over an entire axial length of the second axial portion.

7. The fan according to claim 6, wherein the impeller has a cover disk which begins in the region of the first axial portion and ends at the transition of the first axial portion to the second axial portion.

8. The fan according to claim 1, wherein the flow channel has a third axial portion adjoining the second axial portion in the flow direction (C), and wherein the flow channel has an outer periphery over the entire third axial portion that corresponds to an outer periphery of the flow channel in the second cross section.

9. The fan according to claim 8, wherein the fan housing is formed in two parts and the first axial portion and the second axial portion are provided in a first partial housing and the third axial portion is provided in a second partial housing.

10. The fan according to claim 8, further having a guide wheel arranged in the third axial portion.

11. The fan according to claim 10, wherein the guide wheel has a hub which is arranged concentric to the base area and/or the flow channel and which is formed by a conical wall tapering in the flow direction (C).

12. The fan according to claim 11, wherein the guide wheel is formed integrally with the fan housing and has guide vanes extending from a wall of the fan housing defining the flow channel to the hub.

13. The fan according to claim 6,
wherein the guide wheel forms a motor holder for holding a motor driving the impeller within the fan housing.

14. The fan according to claim 1,
wherein on the suction side of the first axial portion, a suction opening is provided from which in particular an inflow nozzle extends into the flow channel.

15. The fan according to claim 14,
wherein the inflow nozzle adjoins the end face of the first axial portion.

16. The fan according to claim 1,
wherein the outer periphery of the flow channel increases in size continuously in the flow direction (C) at least in the first axial portion and/or the second axial portion.

17. The fan according to claim 1,
wherein the plurality of intermediate cross-sections of the flow channel widen linearly over the entire second axial portion.

18. The fan according to claim 1,
wherein the fan housing has an overall length (L) in the axial direction which is greater than a width of the fan housing which is orthogonal thereto,
and the second axial portion has a length in the axial direction of at least half of the total length (L).

19. The fan according to claim 1,
wherein the fan housing has an overall length (L) in the axial direction which is greater than a width of the fan housing which is orthogonal thereto,
and the second axial portion has a length in the axial direction of at least two thirds of the total length (L).

20. The fan according to claim 1, wherein the outer periphery of the varying cross-section changes shape from a round shape to rectangular shape from the first cross-section to the second cross-section.

* * * * *